US009487971B2

(12) United States Patent
Quach et al.

(10) Patent No.: US 9,487,971 B2
(45) Date of Patent: Nov. 8, 2016

(54) ELECTRO-MECHANICAL LOCKS WITH BEZEL TURNING FUNCTION

(71) Applicant: KWIKSET CORPORATION, Lake Forest, CA (US)

(72) Inventors: Byron Quach, West Covina, CA (US); Hanna Osama Farag, Riverside, CA (US); James Lin, Aliso Viejo, CA (US)

(73) Assignee: Spectrum Brands, Inc., Middleton, WI (US)

( * ) Notice: Subject to any disclaimer, the term of this patent is extended or adjusted under 35 U.S.C. 154(b) by 254 days.

(21) Appl. No.: 14/205,891

(22) Filed: Mar. 12, 2014

(65) Prior Publication Data

US 2014/0260451 A1 Sep. 18, 2014

Related U.S. Application Data

(60) Provisional application No. 61/788,410, filed on Mar. 15, 2013.

(51) Int. Cl.
*E05B 49/00* (2006.01)
*E05B 47/00* (2006.01)
(Continued)

(52) U.S. Cl.
CPC ..... *E05B 47/0012* (2013.01); *E05B 1/0007* (2013.01); *E05B 47/0005* (2013.01); *E05B 47/068* (2013.01); *E05B 47/0657* (2013.01);
(Continued)

(58) Field of Classification Search
CPC ..... E05B 1/00; E05B 1/0007; E05B 2047/0014; E05B 2047/0015; E05B 2047/0017; E05B 2047/002; E05B 2047/0021; E05B 2047/0022; E05B 49/00; E05B 47/00; E05B 47/0001; E05B 47/0002; E05B 47/0003; E05B 47/0005; E05B 47/0012; E05B 47/0657; E05B 47/0661; E05B 47/0676; E05B 47/068
See application file for complete search history.

(56) References Cited

U.S. PATENT DOCUMENTS 2,942,907 A 3/1957 Nagel et al.
D206,373 S 12/1966 James et al.
(Continued)

FOREIGN PATENT DOCUMENTS

FR 2653780 A1 10/1989
JP 2009030426 A 2/2008
(Continued)

OTHER PUBLICATIONS

Schlage Installation Instructions. Manual (online). Schlage Lock Company, Mar. 23, 2009, (retried on Aug. 15, 2012), retrieved from the Internet: <URL: http://consumer.schlage.com/Project%20Documents/P515-858.pdf>.
(Continued)

*Primary Examiner* — Christopher Boswell
(74) *Attorney, Agent, or Firm* — Barnes & Thornburg LLP

(57) ABSTRACT

The present disclosure provides an electro-mechanical lock assembly which illustratively includes a motor, a gear, a driver, a torque member, a housing, and a bezel. The motor is operable upon selective input. The motor is also coupled to the driver to engage both the gear and the housing when the motor is in operation. The bezel is attached to the gear such that when the driver is engaged with both the gear and the housing, manual rotation of the bezel will rotate the housing. The housing is attached to the torque member which is configured to move a latch such that when the bezel rotates the latch is moved.

28 Claims, 9 Drawing Sheets

(51) Int. Cl.

| | |
|---|---|
| ***E05B 1/00*** | (2006.01) |
| ***E05B 47/06*** | (2006.01) |
| *E05B 15/04* | (2006.01) |

(52) U.S. Cl.

CPC ..... *E05B 47/0676* (2013.01); *E05B 49/00* (2013.01); *E05B 1/0061* (2013.01); *E05B 2015/0448* (2013.01); *E05B 2047/002* (2013.01); *E05B 2047/0017* (2013.01); *E05B 2047/0031* (2013.01); *E05B 2047/0058* (2013.01); *Y10T 70/7068* (2015.04)

(56) References Cited

U.S. PATENT DOCUMENTS

| | | | | |
|---|---|---|---|---|
| 3,529,454 | A | 9/1970 | Fish | |
| 3,733,863 | A | 5/1973 | Toepfer | |
| 4,148,092 | A | 4/1979 | Martin | |
| 4,270,781 | A | 6/1981 | Nishimura | |
| 4,640,110 | A | 2/1987 | Fish et al. | |
| 4,656,850 | A | 4/1987 | Tabata | |
| 4,736,970 | A | 4/1988 | McGourty et al. | |
| 4,770,012 | A | 9/1988 | Johansson et al. | |
| 4,854,143 | A | 8/1989 | Corder et al. | |
| 4,893,704 | A | 1/1990 | Fry et al. | |
| 4,901,545 | A * | 2/1990 | Bacon | E05B 13/10 70/207 |
| 5,040,652 | A | 8/1991 | Fish et al. | |
| 5,052,205 | A | 10/1991 | Poli | |
| 5,083,122 | A | 1/1992 | Clark | |
| 5,121,618 | A | 6/1992 | Scott | |
| 5,228,730 | A | 7/1993 | Gokcebay et al. | |
| 5,440,909 | A | 8/1995 | Ely et al. | |
| 5,473,922 | A | 12/1995 | Bair et al. | |
| 5,474,348 | A | 12/1995 | Palmer et al. | |
| 5,475,996 | A | 12/1995 | Chen | |
| 5,609,051 | A | 3/1997 | Donaldson | |
| 5,640,863 | A | 6/1997 | Frolov | |
| 5,709,114 | A | 1/1998 | Dawson et al. | |
| 5,712,626 | A | 1/1998 | Andreou et al. | |
| D390,446 | S | 2/1998 | Gartner | |
| 5,782,118 | A | 7/1998 | Chamberlain et al. | |
| 5,857,365 | A | 1/1999 | Armstrong | |
| 5,873,276 | A | 2/1999 | Dawson et al. | |
| 5,876,073 | A | 3/1999 | Geringer et al. | |
| 5,887,467 | A | 3/1999 | Butterweck et al. | |
| 5,894,277 | A | 4/1999 | Keskin et al. | |
| 5,933,086 | A | 8/1999 | Tischendorf et al. | |
| 5,970,759 | A | 10/1999 | Trilk | |
| 6,016,677 | A | 1/2000 | Clark | |
| 6,038,896 | A | 3/2000 | Chamberlain et al. | |
| 6,076,383 | A * | 6/2000 | Clark | G07C 9/00698 192/48.3 |
| 6,098,433 | A | 8/2000 | Maniaci | |
| 6,107,934 | A | 8/2000 | Andreou et al. | |
| 6,125,673 | A | 10/2000 | Luker | |
| D438,447 | S | 3/2001 | Gartner | |
| 6,196,037 | B1 | 3/2001 | Urschel et al. | |
| 6,264,256 | B1 | 7/2001 | Hankel et al. | |
| 6,286,347 | B1 | 9/2001 | Frolov | |
| 6,297,725 | B1 | 10/2001 | Tischendorf et al. | |
| 6,298,699 | B1 | 10/2001 | Gartner et al. | |
| 6,318,137 | B1 | 11/2001 | Chaum | |
| 6,345,522 | B1 | 2/2002 | Stillwagon et al. | |
| 6,378,344 | B1 | 4/2002 | Gartner | |
| 6,442,983 | B1 | 9/2002 | Thomas et al. | |
| D464,862 | S | 10/2002 | Younani | |
| 6,619,085 | B1 | 9/2003 | Hsieh | |
| 6,622,534 | B1 | 9/2003 | Miller et al. | |
| 6,655,180 | B2 | 12/2003 | Gokcebay et al. | |
| 6,718,808 | B2 | 4/2004 | Yu | |
| 6,845,642 | B2 | 1/2005 | Imedio Ocana | |
| 6,876,293 | B2 | 4/2005 | Frolov et al. | |
| 6,895,791 | B2 | 5/2005 | Alexander et al. | |
| 6,935,149 | B1 | 8/2005 | Peng et al. | |
| 7,051,561 | B2 | 5/2006 | Moon et al. | |
| D526,883 | S | 8/2006 | Gilbert | |
| 7,091,429 | B2 | 8/2006 | Case et al. | |
| 7,096,697 | B2 | 8/2006 | Keightly | |
| 7,096,698 | B2 | 8/2006 | Walsh, III et al. | |
| 7,165,428 | B2 | 1/2007 | Isaacs et al. | |
| 7,168,276 | B2 | 1/2007 | Errani et al. | |
| D536,948 | S | 2/2007 | Fields | |
| D537,319 | S | 2/2007 | Fields | |
| 7,188,495 | B2 | 3/2007 | Errani et al. | |
| 7,424,814 | B2 | 9/2008 | Jasper | |
| 7,543,469 | B1 | 6/2009 | Tseng et al. | |
| 7,591,157 | B2 | 9/2009 | O'Neill et al. | |
| 7,698,919 | B2 | 4/2010 | Kim | |
| D631,323 | S | 1/2011 | Stevens et al. | |
| 7,918,114 | B2 | 4/2011 | Walsh, III | |
| 7,963,134 | B2 | 6/2011 | Rafferty et al. | |
| 7,966,854 | B2 * | 6/2011 | Imedio Ocana | E05B 47/0642 192/69.62 |
| 8,091,392 | B2 | 1/2012 | Miller et al. | |
| 8,276,415 | B2 | 10/2012 | Trempala et al. | |
| 8,375,753 | B2 * | 2/2013 | Goldman | E05B 47/0603 70/277 |
| 8,689,594 | B2 * | 4/2014 | Yanar | E05B 47/0012 70/222 |
| 9,024,759 | B2 * | 5/2015 | Uyeda | E05B 47/00 340/10.4 |
| 2005/0183480 | A1 | 8/2005 | Hingston | |
| 2006/0065027 | A1 | 3/2006 | Valentine | |
| 2008/0078220 | A1 | 4/2008 | Kim | |
| 2008/0296912 | A1 * | 12/2008 | Whitner | E05B 47/0012 292/144 |
| 2009/0133454 | A1 | 5/2009 | Frolov | |
| 2009/0211319 | A1 | 8/2009 | McCormack | |
| 2010/0011822 | A1 * | 1/2010 | Imedio Ocana | E05B 47/0615 70/278.7 |
| 2010/0126240 | A1 | 5/2010 | Pollabauer | |
| 2010/0154494 | A1 * | 6/2010 | Sakai | E05B 9/084 70/277 |
| 2010/0257906 | A1 | 10/2010 | Sorensen et al. | |
| 2011/0079057 | A1 | 4/2011 | Frolov et al. | |
| 2011/0215597 | A1 | 9/2011 | Weum | |
| 2012/0198897 | A1 | 8/2012 | Lui | |
| 2013/0031940 | A1 | 2/2013 | Romero | |
| 2015/0096341 | A1 * | 4/2015 | Overgaard | E05B 47/0012 70/283.1 |

FOREIGN PATENT DOCUMENTS

| | | |
|---|---|---|
| WO | WO 2012/177609 | 12/2012 |
| WO | WO 2012/177609 A1 | 12/2012 |

OTHER PUBLICATIONS

International Searching Authority; International Search Report; Jul. 10, 2014.

* cited by examiner

ELECTRO-MECHANICAL LOCKS WITH BEZEL TURNING FUNCTION

RELATED APPLICATIONS

This application claims the benefit of U.S. Provisional Application Ser. No. 61/788,410, filed Mar. 15, 2013, entitled "Electro-Mechanical Locks With Bezel Turning Function" which is hereby incorporated by reference in its entirety.

TECHNICAL FIELD

The present disclosure relates to door lock assemblies, and particularly to a motor driven locking system that selectively engages and disengages a deadbolt or other latch to extend or retract the same.

An illustrative embodiment of the present disclosure provides an electro-mechanical lock assembly that is configured to automatically engage or disengage a latch, such as a deadbolt. For example, upon entry of an authorized pass code or other indication of authorization, a motor will cause engagement of mechanical parts coupled to the bolt or latch to allow it to be moved under manual means. In other words, upon entrance of a proper code, a motor moves a clutch-like member to engage both a drive and driven component. The drive component may then be manually moved, which moves the driven component, which moves the latch from the locked to unlocked position, or vice versa.

An illustrative embodiment of the present disclosure includes a keypad or another like system that requires a correct combination or key in order to engage the latch. If the correct combination is entered, power is supplied to a motor that rotates a shaft. A pin is attached to the shaft and rotates therewith with the motor. A spring wraps around the shaft that is configured to compress or expand by the pin and depending on the direction of rotation of the shaft. The spring engages a carriage that engages a spline-driver or flower that is moveable between a driver-torque housing and a gear part. When the flower engages both the driver-torque housing and the gear part at the same time, an illustrative bezel attached to the female gear part can be manually moved. Moving, such as rotating the bezel, will rotate the male gear part which rotates the driver-torque housing and blade, which causes the latch to move in one direction or another.

Another illustrative embodiment of the present disclosure provides an electro-mechanical lock assembly. The electro-mechanical lock assembly comprises a keypad, a motor, a gear, a spline-driver, a torque member, a housing, and a bezel. The motor is operable upon selective input to the keypad. The motor is also coupled to the spline-driver to engage both the gear and the housing when the motor is in operation. The bezel is attached to the gear such that when the spline-driver is engaged with both the gear and the housing, manual rotation of the bezel will rotate the housing. The housing is attached to the torque member which is configured to move a latch such that when the bezel rotates the latch is moved.

In the above and other illustrative embodiments, the electro-mechanical lock assembly may further comprise: a base located adjacent the bezel and configured to fit against a door; the keypad being configured to receive a combination code as the selective input to operate the motor; a cable ribbon in communication with a PCB board that determines if a proper combination code as the selective input is entered into the keypad to direct a signal to the motor to operate the motor; the cable ribbon being extendable from the electro-mechanical lock assembly and connectable to a battery case in a turnpiece assembly; the cable ribbon being supported by a support attached to the electro-mechanical lock assembly so the cable ribbon does not interfere with any backset assembly components that move a door latch or bolt; a drive rod being attachable to the motor; wherein the drive rod rotates as the motor operates; a pin extends transversely through the drive rod and rotates with the drive rod; a spring is wound around the drive rod; a second spring extends from the spline-driver to the housing; wherein the pin acts as a cam follower by engagement of the coil wire of the spring; engagement of the coil wire of the spring compresses or extends the spring along the longitudinal length of the drive rod; a carriage is movable back and forth along the drive rod such that as the spring expands or compresses the carriage is engagable with the spline-driver such that as the pin extends or retracts the spring, the spline-driver is likewise pulled or pushed; the second spring is in compression so it biases the spline-driver towards the pin; when the spline-driver is moved to a location that is between both the housing and the gear, manually rotating the bezel which is attached to the gear, it rotates the housing which is attached to and rotates the torque member; when the spline-driver is not engaged to both the housing and the gear, the housing will not rotate the torque member; the torque member being attached to the housing by a second pin; the turnpiece assembly includes a plate; a battery case; a button; vibration dampening pads; a rose; and a knob; and the button may engage a switch mechanism that is in communication with at least one battery in the battery case to send a signal through the ribbon cable to operate the motor.

Another illustrative embodiment provides an electro-mechanical lock assembly. It comprises a motor, a coupling, a driver, a torque member, a housing, and a bezel. The motor is coupled to the driver to engage both the coupling and the housing when the motor is in operation. The bezel is attached to the coupling such that when the driver is engaged with both the coupling and the housing, manual rotation of the bezel will rotate the housing. Lastly, the housing is attached to the torque member which is configured to move a latch such that when the bezel rotates the latch is moved.

In the above and other illustrative embodiment, the electro-mechanical lock assembly may further comprise: a base located adjacent the bezel and configured to fit against a door; a keypad configured to receive a combination code to operate the motor; a cable ribbon in communication with a PCB board that determines if a proper combination code as the selective input is entered into the keypad to direct a signal to the motor to operate the motor; the cable ribbon being extendable from the electro-mechanical lock assembly and connectable to a battery case in a turnpiece assembly; the cable ribbon being supported by a support attached to the electro-mechanical lock assembly so the cable ribbon does not interfere with any backset assembly components that move a door latch or bolt; a drive rod that is attached to the motor; wherein the drive rod rotates as the motor operates; a pin extends transversely through the drive rod and rotates with the drive rod; a spring is wound around the drive rod; a second spring extends from the driver to the housing; wherein the pin acts as a cam follower by engagement of the coil wire of the spring; engagement of the coil wire of the spring compresses or extends the spring along the longitudinal length of the drive rod; a carriage being movable back and forth along the drive rod such that as the spring expands or compresses, the carriage is engagable with the driver such that as the pin extends or retracts the spring the driver is likewise pulled or pushed; the second spring being in compression so it biases the driver towards the pin; when the driver is moved to a location that is between both the housing and the coupling, manually rotating the bezel which is attached to the coupling, rotates the housing which is attached to and rotates the torque member; when the driver is not engaged to both the housing and the coupling, the housing will not rotate the torque member; the torque member being attached to the housing by a second pin; the turnpiece assembly including a plate, a battery case, a button, vibration dampening pads, a rose, and a knob; and the button may engage a switch mechanism that is in communication with at least one battery in the battery case to send a signal through the ribbon cable to operate the motor.

Additional features and advantages of the lock assembly will become apparent to those skilled in the art upon consideration of the following detailed description of the illustrated embodiment exemplifying the best mode of carrying out the lock assembly as presently perceived.

BRIEF DESCRIPTION OF THE DRAWINGS

The present disclosure will be described hereafter with reference to the attached drawings which are given as non-limiting examples only, in which.

Figure 1:
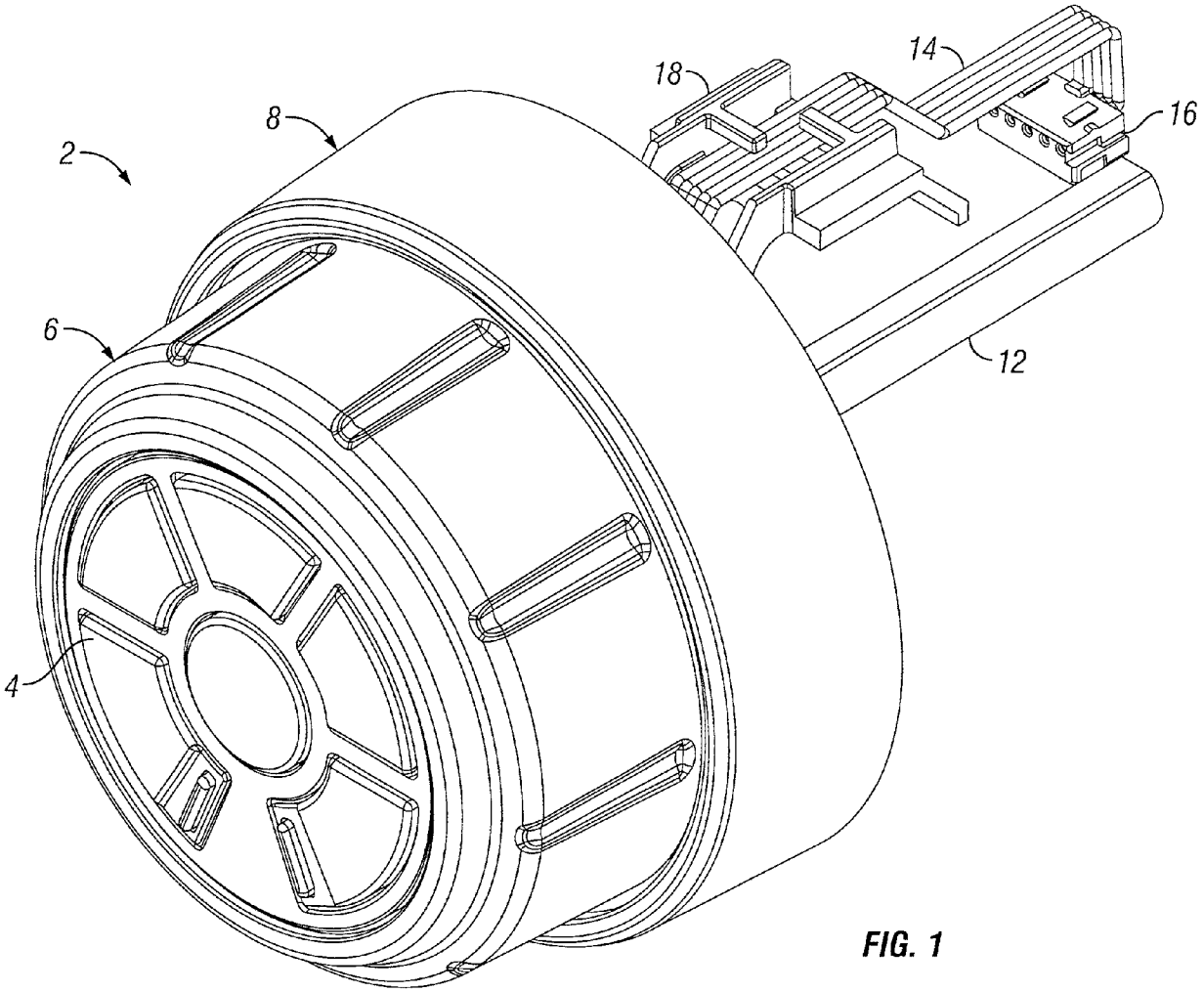
FIG. 1 is a perspective view of an electro-mechanical lock bezel assembly.

Corresponding reference characters indicate corresponding parts throughout the several views. The exemplification set out herein illustrates embodiments of the electro-mechanical lock assembly, and such exemplification is not to be construed as limiting the scope of the electro-mechanical lock assembly, in any manner.

DETAILED DESCRIPTION OF THE DRAWINGS

A perspective view of an electro-mechanical lock bezel assembly component 2 is shown in FIG. 1. Assembly component 2 includes a keypad assembly 4 fitted within a rotatable bezel 6 adjacent a base 8 configured to fit against a door and cover a through bore 10. (See, also, FIG. 3.) Keypad 4 is configured to receive a combination code in order to activate a mechanism to unlock the door. Upon receipt of a proper code, assembly 2 activates so bezel 6 can be rotated to engage and rotate torque blade 12 which throws the latch to either locked or unlocked position. It is appreciated in this embodiment that bezel 6 may rotate with respect to base 8. Cable ribbon 14 and connector 16 are configured to extend through bore 10 and connect to a battery case 86 in turnpiece assembly 20 located on the interior portion of door 22. (See, also, FIGS. 8 and 9.) Cable ribbon 14 is supported by a support 18 so as not to interfere with any of the backset assembly components that move the latch or bolt (not shown).

Figure 2:
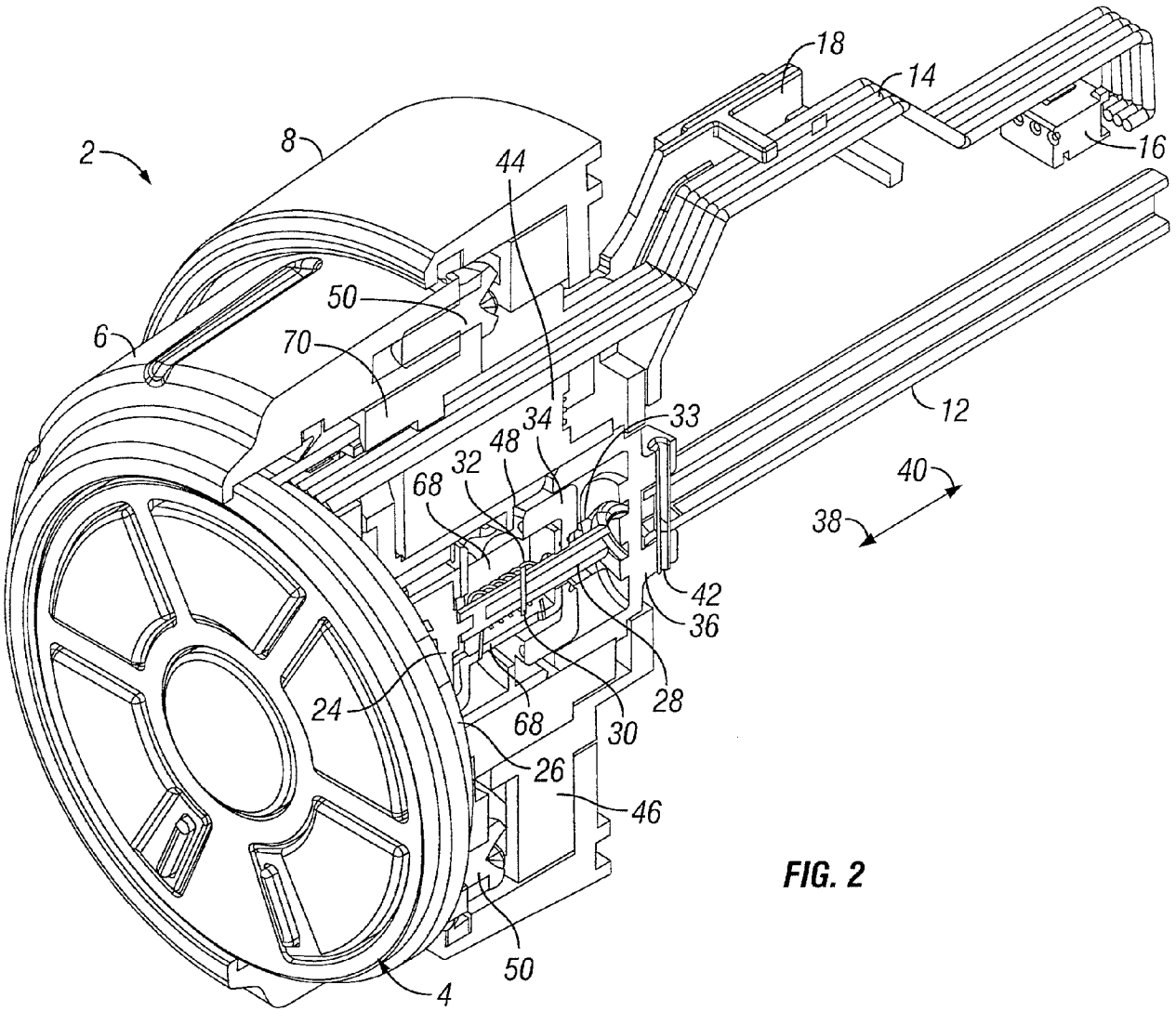
FIG. 2 is a cross-sectional perspective view of the electro-mechanical lock bezel assembly.

A cross-sectional perspective view of assembly 2 is shown in FIG. 2. This view shows keypad assembly 4, bezel 6, and base 8 as discussed with respect to FIG. 1. Also shown herein is motor 24 which is in communication with a PCB board 26 that receives power through cable ribbon 14. PCB board 26 determines if a proper combination is entered into keypad 4 and, if so, directs a signal to motor 24 to cause it to rotate. A drive rod 28 is attached to motor 24 and rotates as motor 24 rotates. Pin 30 extends essentially transversely to drive rod 28 and rotates therewith. Spring 32 is wound around drive rod 28. A second spring 33 extends from flower 34 up into a torque-driver housing 36. Pin 32 extends from drive rod 28 and acts as a cam follower by engaging the coil wire of spring 30. This has the effect of compressing or extending spring 32 in one direction or another along the longitudinal length of drive rod 28. A carriage 68 moves back and forth in directions 38 and 40, as spring 32 expands and compresses. Flower 34 is engaged by carriage 68 so that as pin 30 extends or retracts spring 32 in either direction 38 or 40, flower 34 is likewise pulled or pushed in directions 38 and 40. Second spring 33 is in compression so it is configured to bias flower 34 in direction 38. When flower 34 is moved to a location that is between both torque driven housing 36 and gear 48, manually rotating bezel 6, which is fastened to gear portion 70 via fasteners 50, rotates gear 48 which through flower 34 rotates housing 36 which is attached to and rotates torque blade 12. As previously discussed, torque blade 12 is attached to a backset assembly (not shown) which will throw the latch or bolt when torque blade 12 rotates. It is further shown in this view that torque blade 12 is coupled to torque-driver housing 36 via a pin 42. This view also shows body 44 surrounding motor 24. Cover base 46 is attached to base 8 and located adjacent body 44 which itself is adjacent movable gear 48.

Figure 3:
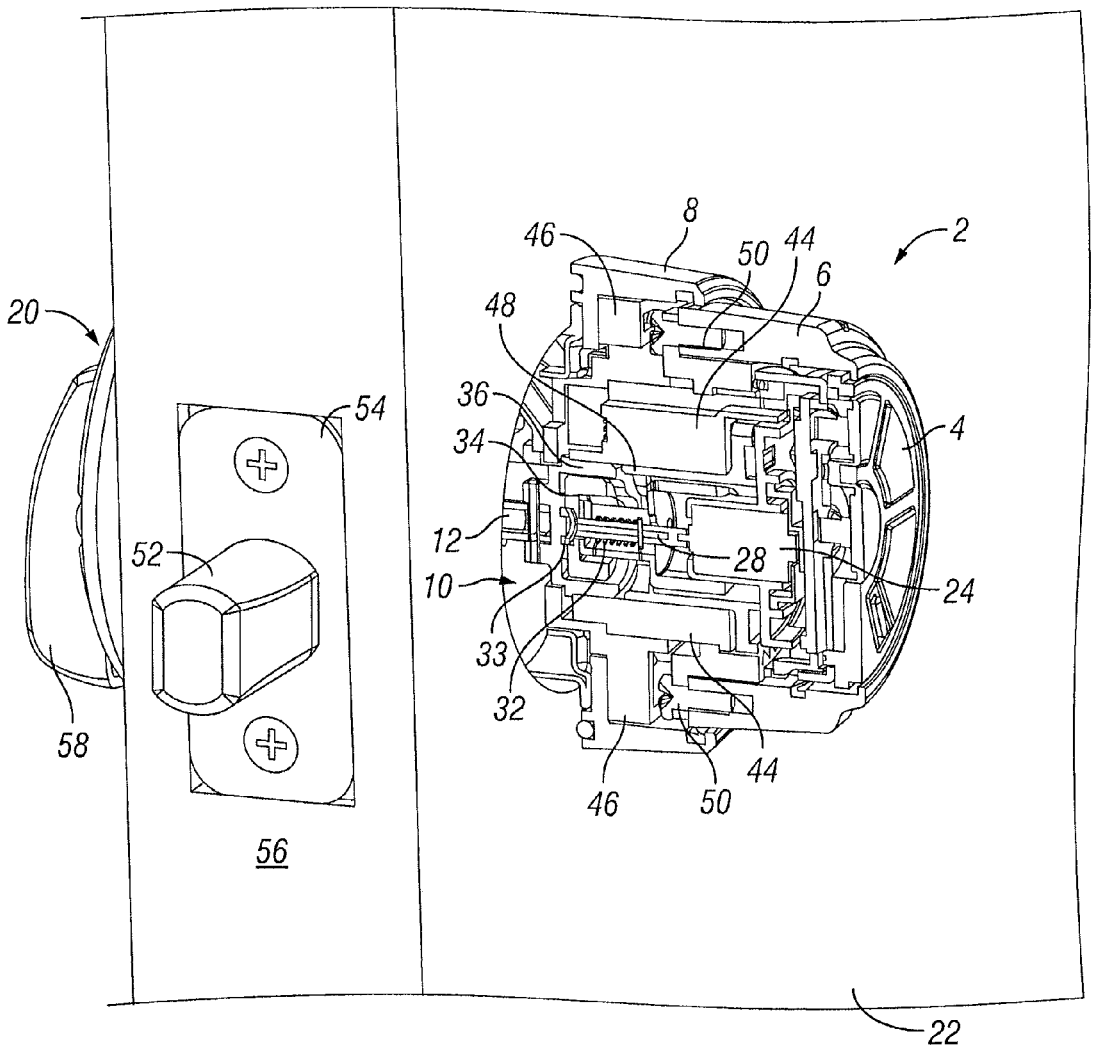
FIG. 3 is a perspective view of the electro-mechanical lock assembly proponent attached to a door and extending through a bore to a turnpiece assembly.

A perspective view of electro-mechanical lock bezel assembly component 2, attached to door 22 and extending through bore 10 to turnpiece assembly 20, is shown in FIG. 3. In this view, assembly 2 is coupled to a deadbolt 52 which extends through base plate 54 and edge 56 of door 22. This view demonstrates that when deadbolt 52 is extended (i.e., in the locked position) assembly 2 will not allow deadbolt 52 to retract (unless a proper code is entered). Here flower 34 is not engaged to both housing 36 and gear 48, so either no code or improper code has been entered into keypad assembly 4. It is appreciated that after deadbolt 52 is moved to the locked position, as shown herein, motor 24 rotates drive rod 28 causing spring 32 and carriage 68 (see, also, FIG. 5) to move flower 34 up into torque-driver housing 36 (against the bias of second spring 33). This means that flower 34 is no longer in contact with both housing 36 and gear 48. And because bezel 6 is attached to gear 48 via gear portion 70, but no longer housing 36, rotating bezel 6 will no longer rotate blade 12. It is appreciated that the gear 48, flower 34, and housing 36 all have complimentary cross sections so that when flower 34 engages both housing 36 and gear 48, all will rotate together. As this view shows, however, with flower 34 positioned so it specifically does not engage gear 48, there is no way to make torque blade 12 rotate. Without torque blade 12 rotating, there is likewise no way to move deadbolt 52. In other words, there becomes a mechanical separation between bezel 6 and deadbolt 52 preventing the latter from moving. Also shown in this view is cover base 46, body 44, and fasteners 50. It is appreciated from this view that turnpiece assembly 20 may include a knob 58 that is also engageable with torque blade 12. As knob 58 rotates deadbolt 52 extends and retracts via conventional means.

Figure 4:
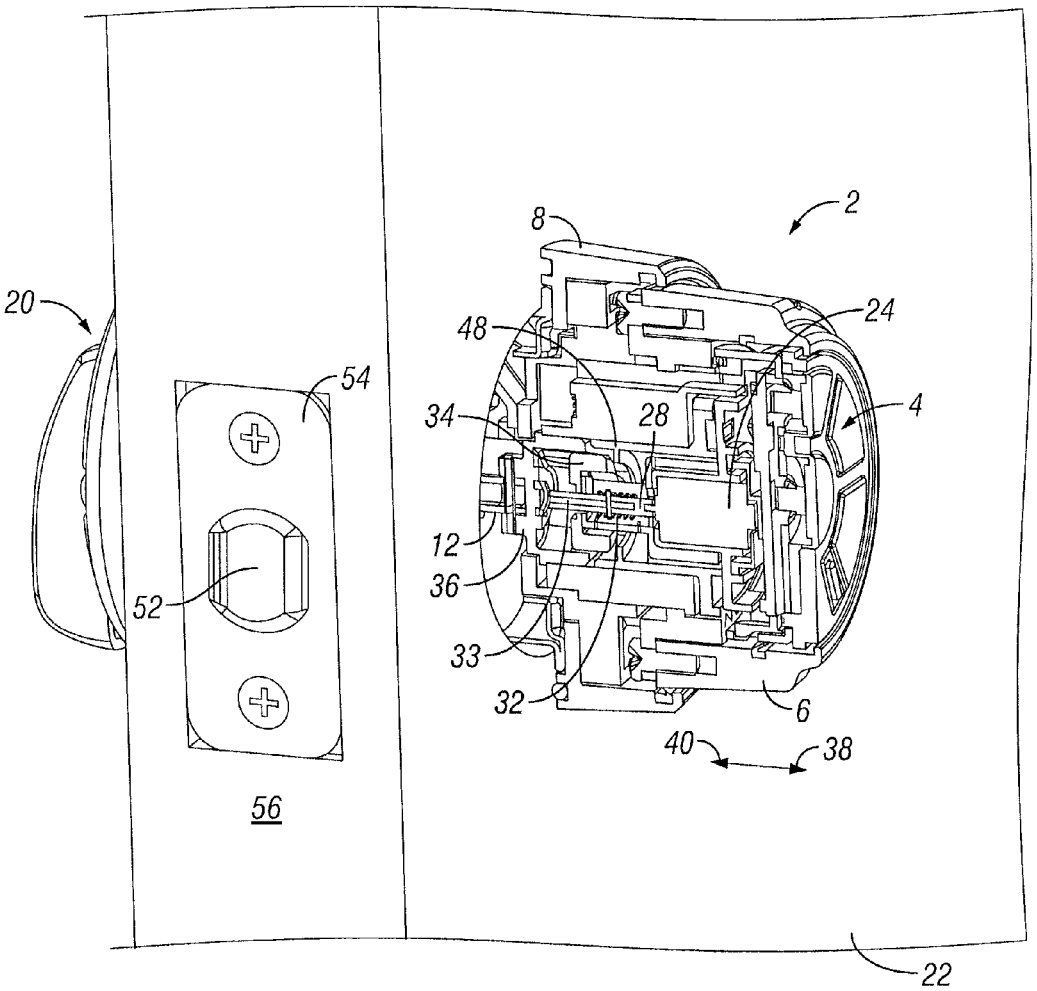
FIG. 4 is another perspective view of the electro-mechanical lock bezel assembly component coupled to a door and turnpiece assembly.

Another perspective view of electro-mechanical lock bezel assembly component 2 coupled to door 22 and turnpiece assembly 20 is shown in FIG. 4. This view differs from the view in FIG. 3 in that here deadbolt 52 is retracted into door 22 about flush with base plate 54, indicating an unlocked position. In this view, a correct code was entered into keypad assembly 4, which caused motor 24 to activate and rotate drive rod 28 to move carriage 68 (see, also, FIG. 5) so that flower 34 will be drawn from its location solely inside housing 36 in direction 38 and positions between both housing 36 and gear 48. As previously discussed, when flower 34 straddles both housing 36 and gear 48, a mechanical connection is created so that rotating bezel 6 rotates torque blade 12 which extends or retracts deadbolt 52.

Figure 5:
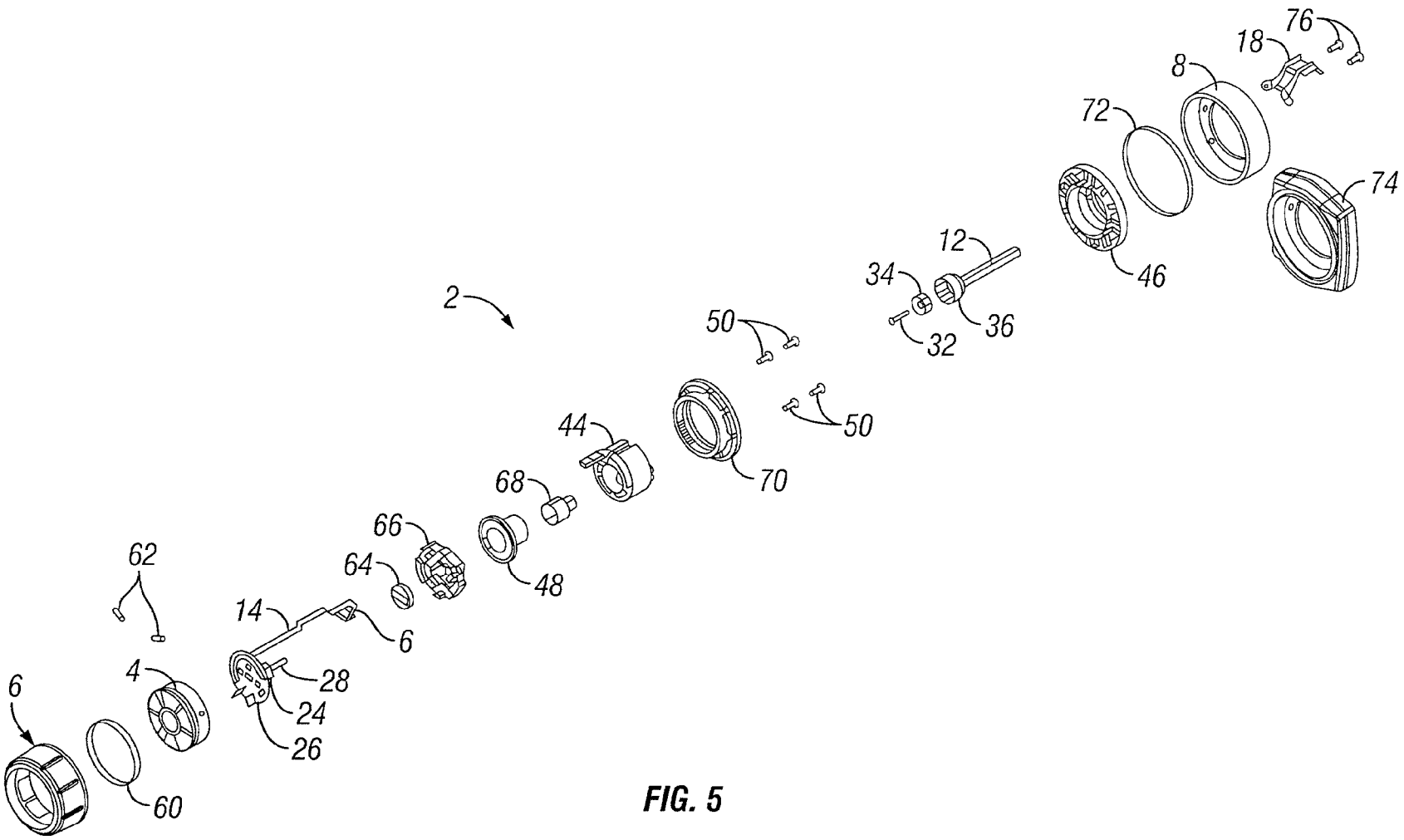
FIG. 5 is an exploded view of the electro-mechanical lock bezel assembly.

An exploded view of electro-mechanical lock bezel assembly component 2 is shown in FIG. 5. This view shows the several components used to make up assembly 2, as described in FIGS. 1-4. The components include bezel 6, bezel lip ring 60, fasteners 62, keypad 4, PCB board 26 with ribbon cable 14, connector 6, motor 24, torque blade 12, a motor skirt 64, motor plate 66, gear 48, carriage 68, body 44, gear portion 70, fasteners 50, spring 32, flower 34, torque-driver housing 36, torque blade 12, cover base 46, bezel lip ring 72, base 8, optional square base 74, support 18, and fasteners 76. Illustratively, fasteners 76 attach support 18 to body 44.

Figure 6:
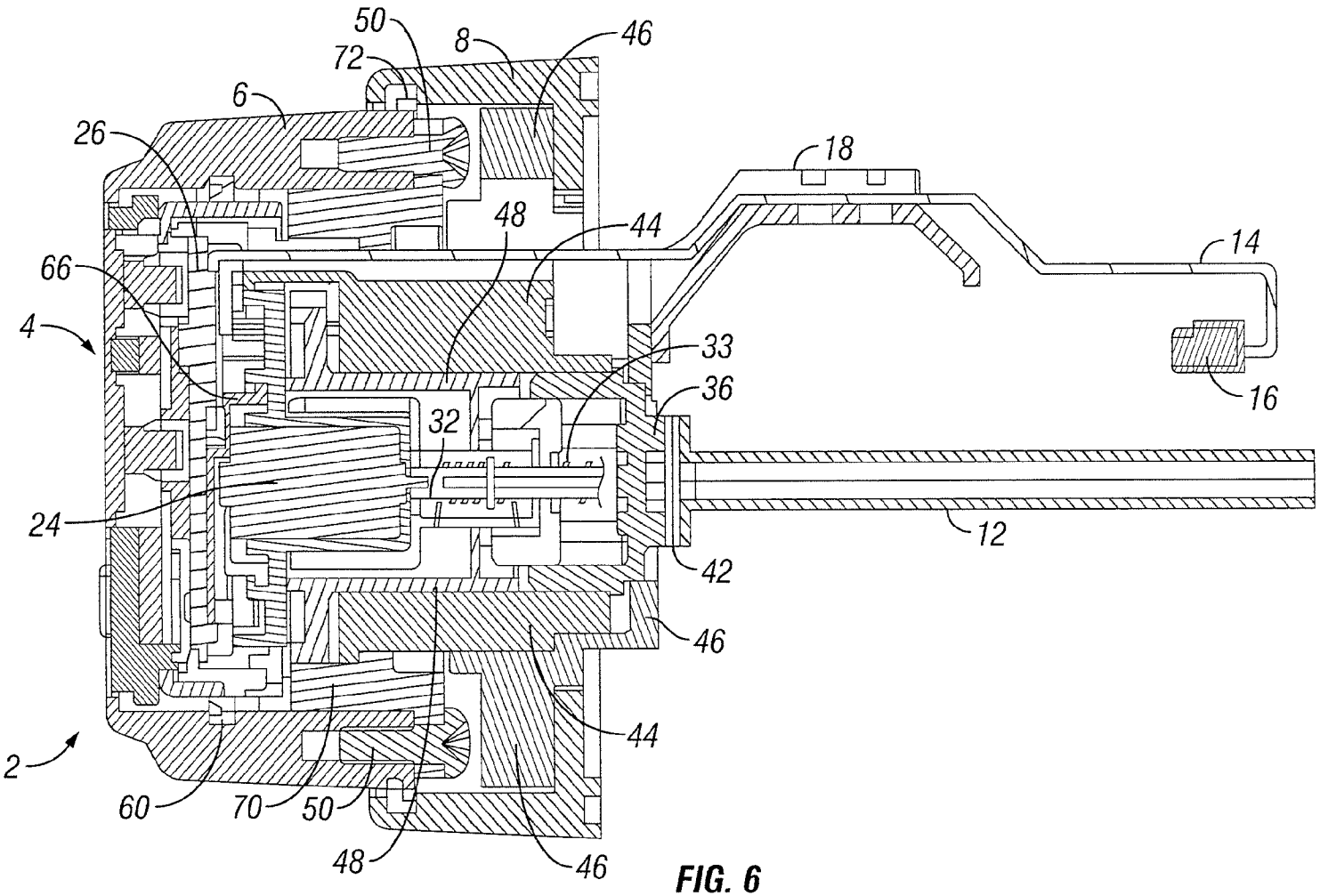
FIG. 6 is a side cross-sectional view of the electro-mechanical lock bezel assembly.

A side cross-sectional view of electro-mechanical lock bezel assembly component 2 is shown in FIG. 6. This view assists demonstrating how the components are assembled together. Torque blade 12 is shown attached to torque-driver housing 36 via pin 42. Connector 16 is attached to ribbon cable 14 and itself is attached to PCB board 26. Support 18 is attached to body 44 along with base 8 which is also located adjacent bezel 6. Body 44 is located inside assembly 2 adjacent gear 48. It is appreciated that gear 48 and gear portion 70 are meshed together. Gear portion 70 is coupled to bezel 6 via fasteners 50. Lip rings 72 and 60, as shown, keep contaminants from getting into assembly 2 via seams between bezel 6/base 8 and bezel 6/keypad assembly 4, respectively. Motor plate 66 shrouds motor 24 as shown.

Figure 7:
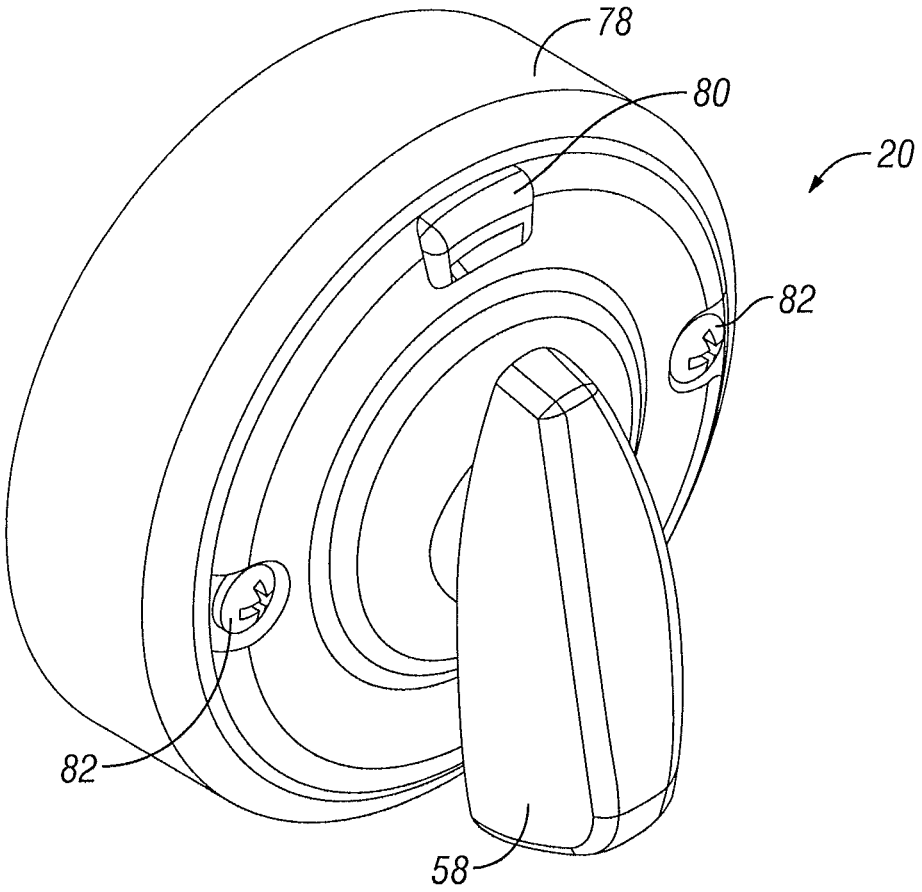
FIG. 7 is a perspective view of the turnpiece assembly.

A perspective view of turnpiece assembly 20 is shown in FIG. 7. This view shows knob 58 extending from rose 78. Button 80 extends from rose 78 as well. Fasteners 82 are also shown in this view.

Figure 8:
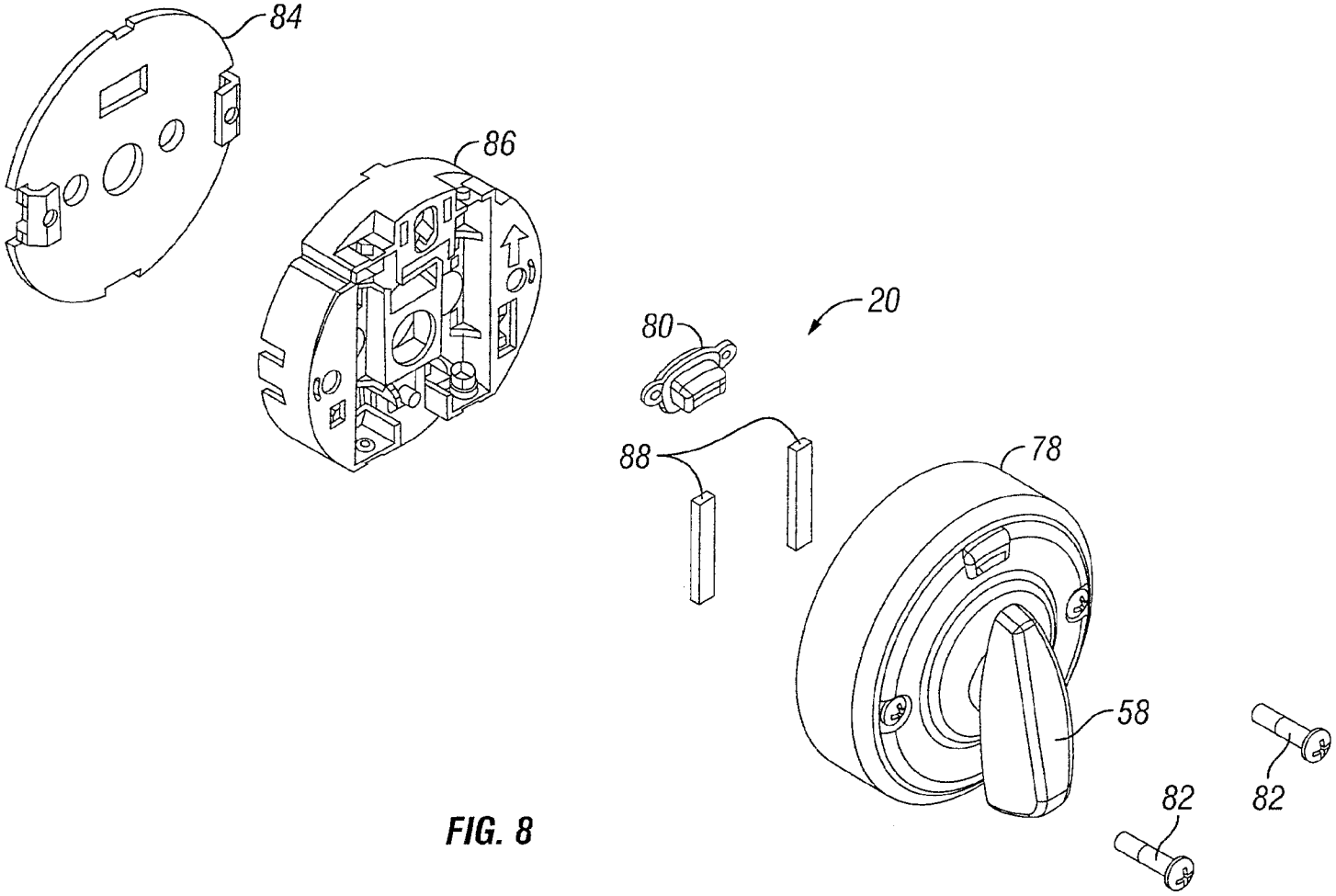
FIG. 8 is a perspective exploded view of the turnpiece assembly.

A perspective exploded view of turnpiece assembly 20 is shown in FIG. 8. This view includes plate 84; battery case 86; button 80; vibration dampening pads 88; rose 78; knob 58; and fasteners 82.

Figure 9:
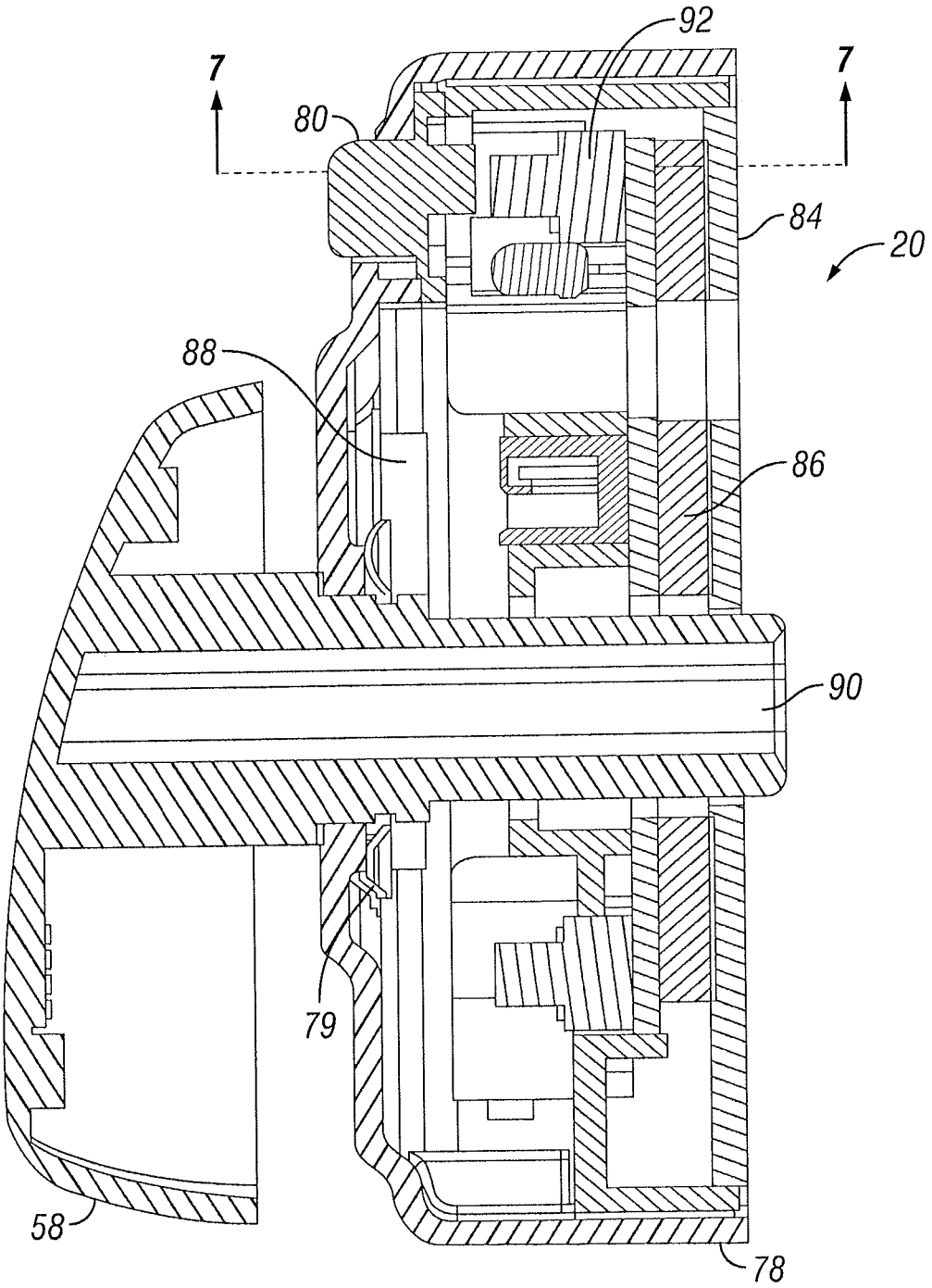
FIG. 9 is a side cross-sectional view of the turnpiece assembly.

The side cross-sectional view of turnpiece assembly 20 is shown in FIG. 9 depicting how the components shown in FIG. 8 are fitted together. Knob 58 includes a bore 90 configured to receive torque blade 12 so that turning knob 58 will also move deadbolt 52. Knob 58 is attached to rose 78 via clip 79. Fitted in rose 78 is battery case 86, vibration dampening pads 88, and button 80 is capped by plate 84. It is appreciated that battery case 86 is configured to store one or a plurality of batteries and connect to connector 16 to deliver power to PCB board 26. In addition, button 80 may engage a switch mechanism 92 that may be part of battery case 86, or adjacent battery case 86, to send a signal through connector 16, ribbon cable 14, and PCB board 26 to activate motor 24 to either retract or extend deadbolt 52.

Although the present disclosure has been described with reference to particular means, materials, and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

What is claimed is:

1. An electro-mechanical lock assembly comprising:
a keypad;
a motor;
a gear;
a spline-driver;
a torque member;
a torque-driver housing;
a bezel;
wherein the motor is operable upon selective input to the keypad;
wherein the gear is axially aligned with the torque-driver housing;
wherein the motor is coupled to the spline-driver to cause the spline-driver to engage both the gear and the torque-driver housing when the motor is in operation;
wherein the bezel is attached to the gear such that when the spline-driver is engaged with both the gear and the torque-driver housing, manual rotation of the bezel will rotate the torque-driver housing; and
wherein the torque-driver housing is attached to the torque member which is configured to move a latch such that when the bezel rotates the latch is moved.

2. The electro-mechanical lock assembly of claim 1, further comprising a base located adjacent the bezel and configured to fit against a door.

3. The electro-mechanical lock assembly of claim 1, wherein the keypad is configured to receive a combination code as the selective input to operate the motor.

4. The electro-mechanical lock assembly of claim 1, further comprising a cable ribbon in communication with a PCB board that determines if a proper combination code as the selective input is entered into the keypad to direct a signal to the motor to operate the motor.

5. The electro-mechanical lock assembly of claim 4, wherein the cable ribbon is extendable from the electro-mechanical lock assembly and connectable to a battery case in a turnpiece assembly.

6. The electro-mechanical lock assembly of claim 5, wherein the cable ribbon is supported by a support attached to the electro-mechanical lock assembly so the cable ribbon does not interfere with any backset assembly components that move a door latch or bolt.

7. The electro-mechanical lock assembly of claim 5, wherein the turnpiece assembly includes a plate, the battery case, a button, vibration dampening pads, a rose, and a knob.

8. The electro-mechanical lock assembly of claim 7, wherein the button may engage a switch mechanism that is in communication with at least one battery in the battery case to send a signal through the ribbon cable to operate the motor.

9. The electro-mechanical lock assembly of claim 1, further comprising a drive rod that is attached to the motor; wherein the drive rod rotates as the motor operates; a pin extends transversely through the drive rod and rotates with the drive rod; a spring is wound around the drive rod; a second spring extends from the spline-driver to the torque-driver housing; wherein the pin acts as a cam follower by engagement of the coil wire of the spring.

10. The electro-mechanical lock assembly of claim 9, wherein engagement of the coil wire of the spring compresses or extends the spring along the longitudinal length of the drive rod; a carriage is movable back and forth along the drive rod such that as the spring expands or compresses the carriage is engagable with the spline-driver such that as the pin extends or retracts the spring the spline-driver is likewise pulled or pushed.

11. The electro-mechanical lock assembly of claim 10, wherein the second spring is in compression so it biases the spline-driver towards the pin.

12. The electro-mechanical lock assembly of claim 1, wherein the torque member is attached to the torque-driver housing by a second pin.

13. An electro-mechanical lock assembly comprising:
a keypad;
a motor;
a gear;
a spline-driver;
a torque member;
a torque-driver housing;
a bezel;
wherein the motor is operable upon selective input to the keypad;
wherein the motor is coupled to the spline-driver to cause the spline-driver to engage both the gear and the torque-driver housing when the motor is in operation;
wherein the bezel is attached to the gear such that when the spline-driver is engaged with both the gear and the torque-driver housing and the spline-driver-is moved to a location that is between both the torque-driver housing and the gear, manually rotating the bezel attached to the gear rotates the torque-driver housing which is attached to and rotates the torque member; and
wherein the torque member is configured to move a latch such that when the bezel rotates the latch is moved.

14. The electro-mechanical lock assembly of claim 13, wherein when the spline-driver is not engaged to both the torque-driver housing and the gear, the torque-driver housing will not rotate the torque member.

15. An electro-mechanical lock assembly comprising:
a motor;
a coupling;
a driver;
a torque member;
a torque-driver housing;
a bezel;
wherein the motor is coupled to the driver to engage both the coupling and the torque-driver housing when the motor is in operation;
wherein the gear is axially aligned with the torque-driver housing;
wherein the bezel is attached to the coupling such that when the driver is engaged with both the coupling and the torque-driver housing, manual rotation of the bezel will rotate the torque-driver housing; and
wherein the torque-driver housing is attached to the torque member which is configured to move a latch such that when the bezel rotates the latch is moved.

16. The electro-mechanical lock assembly of claim 15, further comprising a base located adjacent the bezel and configured to fit against a door.

17. The electro-mechanical lock assembly of claim 15, further comprising a keypad that is configured to receive a combination code to operate the motor.

18. The electro-mechanical lock assembly of claim 15, further comprising a cable ribbon in communication with a PCB board that determines if a proper combination code as the selective input is entered into the keypad to direct a signal to the motor to operate the motor.

19. The electro-mechanical lock assembly of claim 18, wherein the cable ribbon is extendable from the electro-mechanical lock assembly and connectable to a battery case in a turnpiece assembly.

20. The electro-mechanical lock assembly of claim 19, wherein the cable ribbon is supported by a support attached to the electro-mechanical lock assembly so the cable ribbon does not interfere with any backset assembly components that move a door latch or bolt.

21. The electro-mechanical lock assembly of claim 19, wherein the turnpiece assembly includes a plate, the battery case, a button, vibration dampening pads, a rose, and a knob.

22. The electro-mechanical lock assembly of claim 21, wherein the button may engage a switch mechanism that is in communication with at least one battery in the battery case to send a signal through the ribbon cable to operate the motor.

23. The electro-mechanical lock assembly of claim 15, further comprising a drive rod that is attached to the motor; wherein the drive rod rotates as the motor operates; a pin extends transversely through the drive rod and rotates with the drive rod; a spring is wound around the drive rod; a second spring extends from the driver to the torque-driver housing; wherein the pin acts as a cam follower by engagement of the coil wire of the spring.

24. The electro-mechanical lock assembly of claim 23, wherein engagement of the coil wire of the spring compresses or extends the spring along the longitudinal length of the drive rod; a carriage is movable back and forth along the drive rod such that as the spring expands or compresses the carriage is engagable with the driver such that as the pin extends or retracts the spring, the driver is likewise pulled or pushed.

25. The electro-mechanical lock assembly of claim 24, wherein the second spring is in compression so it biases the driver towards the pin.

26. The electro-mechanical lock assembly of claim 15, wherein the torque member is attached to the torque-driver housing by a second pin.

27. An electro-mechanical lock assembly comprising:
a motor;
a coupling;
a driver;
a torque member;
a torque-driver housing;
a bezel;
wherein the motor is coupled to the driver to engage both the coupling and the torque-driver housing when the motor is in operation;
wherein the bezel is attached to the coupling such that when the driver is engaged with both the coupling and the torque-driver housing and the driver is moved to a location that is between both the torque-driver housing and the coupling, manually rotating the bezel attached to the coupling rotates the torque-driver housing which is attached to and rotates the torque member; and
wherein the torque member is configured to move a latch such that when the bezel rotates the latch is moved.

28. The electro-mechanical lock assembly of claim 27, wherein when the driver is not engaged to both the torque-driver housing and the coupling, the torque-driver housing will not rotate the torque member.

* * * * *